US006937833B2

(12) United States Patent
Katoh et al.

(10) Patent No.: US 6,937,833 B2
(45) Date of Patent: Aug. 30, 2005

(54) IMAGE FORMING APPARATUS HAVING SELECTIVELY REMOVABLE IMAGE PROCESSING AND TONER MODULES

(75) Inventors: Ituro Katoh, Nara-ken (JP); Shoichiro Yoshiura, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 219 days.

(21) Appl. No.: 10/294,799

(22) Filed: Nov. 15, 2002

(65) Prior Publication Data

US 2003/0068171 A1 Apr. 10, 2003

Related U.S. Application Data

(63) Continuation of application No. 08/866,300, filed on May 30, 1997, now abandoned, which is a division of application No. 08/460,087, filed on Jun. 2, 1995, now Pat. No. 5,697,008, which is a division of application No. 08/181,951, filed on Jan. 18, 1994, now Pat. No. 5,541,715, which is a continuation of application No. 07/388,292, filed on Jul. 21, 1989, now abandoned, which is a continuation of application No. 07/235,762, filed on Aug. 23, 1988, now abandoned, which is a continuation of application No. 07/058,857, filed on Jun. 5, 1987, now abandoned.

(30) Foreign Application Priority Data

Jun. 6, 1986 (JP) ..... P 61-132091

(51) Int. Cl.[7] ..... G03G 21/18
(52) U.S. Cl. ..... 399/113; 399/120
(58) Field of Search ..... 399/35, 119, 120, 399/110, 111, 359, 113

(56) References Cited

U.S. PATENT DOCUMENTS

| | | | |
|---|---|---|---|
| 3,752,576 | A | 8/1973 | Gerbasi |
| 4,101,211 | A | 7/1978 | Kayson |
| 4,252,434 | A | 2/1981 | Nakamura et al. |
| 4,460,267 | A | 7/1984 | Ogawa |
| 4,563,074 | A | 1/1986 | Tsuitsui et al. |
| 4,591,258 | A | 5/1986 | Nishino et al. |
| 4,607,939 | A | 8/1986 | Saito |
| 4,611,899 | A | 9/1986 | Kasamura et al. |
| 4,619,514 | A | 10/1986 | Ide |
| 4,660,960 | A | 4/1987 | Fukunaga et al. |
| 4,696,565 | A | 9/1987 | Imanaka |
| 4,803,512 | A | 2/1989 | Ogura et al. |
| 4,821,063 | A | 4/1989 | Kaneshige |
| RE33,484 | E | 12/1990 | Imanaka |

FOREIGN PATENT DOCUMENTS

| | | |
|---|---|---|
| DE | 3522296 | 6/1985 |
| EP | 0101325 | 8/1983 |
| EP | 0176207 | 8/1985 |
| EP | 8504733 | 10/1985 |

(Continued)

OTHER PUBLICATIONS (Attachment A) Translation of JP–A 59–61859 by Nakahata et al, Published on Apr. 9, 1984 (pp. 1–10).*

(Continued)

*Primary Examiner*—Robert Beatty
(74) *Attorney, Agent, or Firm*—Birch, Stewart, Kolasch & Birch, LLP

(57) ABSTRACT

An image formation apparatus contains a first and second unit. The first unit, which is a self-contained first module, contains a photo-sensitive body and structure for removing residue toner from the photo sensitive body. The second unit, which is a self-contained developer module, provides toner to the first unit and receives the residue toner from the first unit. The residue toner in the second unit is received in a self contained container and does not mix with fresh toner. The modules are detachably mounted in the apparatus. The second module cannot be mounted in the apparatus until the first module is mounted. The two units have different lives of interchange.

11 Claims, 5 Drawing Sheets

FOREIGN PATENT DOCUMENTS

| | | |
|---|---|---|
| JP | 50 1741 | 1/1975 |
| JP | 51 2433 | 1/1976 |
| JP | 54122853 | 8/1979 |
| JP | 55 52807 | 4/1980 |
| JP | 59 61859 | 4/1984 |
| JP | 59184373 | 10/1984 |
| JP | 60 52862 | 3/1985 |
| JP | 60168159 | 8/1985 |
| JP | 60254072 | 12/1985 |
| JP | 61026073 | 2/1986 |
| JP | 61258276 | 11/1986 |
| JP | 62 03248 | 2/1987 |

OTHER PUBLICATIONS (Attachment B) Translation of JP–A 55–052807 by Ikeda et al, Published on Apr. 17, 1980 (pp. 1–16).*

Fuji Xerox K.K., "Supplying and Collecting Toner Bottle", 59–184373, Apr. 5, 1983.

Canon K.K., "Image Forming Device and Developer Supplementary Container", 60–233678, May 7, 1984.

Japanese Laid–open Patent Publication #60–101571, "Image Forming Apparatus Attached with Effluent Toner", Nov. 8, 1995.

Japanese Patent Publication No. 63–10424, "Process Cartridge and Image Forming Appartus Using the Same", Aug. 5, 1985.

Japanese Laid–open Patent Publication #55–101979, "Copying Apparatus", Aug. 4, 1980.

* cited by examiner

IMAGE FORMING APPARATUS HAVING SELECTIVELY REMOVABLE IMAGE PROCESSING AND TONER MODULES

This application is a continuation of Application Ser. No. 08/866,300, filed on May 30, 1997, now abandoned, which is divisional of application Ser. No. 08/460,087 filed on Jun. 2, 1995, now U.S. Pat. No. 5,697,008 issued Dec. 9, 1998, which is a divisional of application Ser. No. 08/181,951 filed on Jan. 18, 1994, now U.S. Pat No. 5,541,715 issued Jul. 30, 1996, which is a continuation of application Ser. No. 07/388,292 filed on Jul. 21, 1989, (now abandoned), which is a continuation of application Ser. No. 07,235,762 filed on Aug. 23, 1988, (now abandoned), which is a continuation of application Ser. No. 07/058,857, filed on Jun. 5, 1987, now abandoned the entire contents of which are hereby incorporated by reference and for which priority is claimed under 35 U.S.C. § 120; and this application claims priority of application Ser. No. 61-132091 filed in Japan on Jun. 6, 1986 under 35 U.S.C. § 119.

BACKGROUND OF THE INVENTION

This invention relates to an image formation apparatus having a unit to develop electrostatic latent images formed on an image carrier and a mechanism to recover waste toner.

In image formation equipment such as electronic photocopying equipment, an electrostatic latent image is formed on a photosensitive agent which is the image carrier and this latent image is developed by a developer. The toner used for this developing method has been generally black. Recently, however, mono-color developing using where red, blue and other toners are used by changing the developing unit for installation to the main body of the equipment has been increasing. However, a compact image forming unit which includes a developing system has not been developed.

SUMMARY OF THE INVENTION

The object of this invention is to decrease the size of the unit which includes the developing equipment irrespective of the life of the image carrier by configuring the image formation unit with a first unit containing an image carrier and a second unit consisting of a developer and a waste toner recovery container.

Especially, this investigation is intended for the easy replacement of the developing unit and discarding of the waste toner by just replacing the second unit which includes the developer.

Briefly described, in accordance with the present invention, an image formation apparatus is provided having a first unit, for example a case, consisting of an image carrier and at least a cleaner being held to one supporter and a second unit, for example a case, consisting of a developer to develop an electrostatic latent image formed on the image carrier, the first and second units being installed removably to the image formation apparatus.

BRIEF DESCRIPTION OF THE DRAWINGS

The invention will become more fully understood from the detailed description given hereinbelow and the accompanying drawings which are given by way of illustration only, and thus are not limitative of the present invention and wherein.

DESCRIPTION OF THE PREFERRED EMBODIMENT

Figure 1:
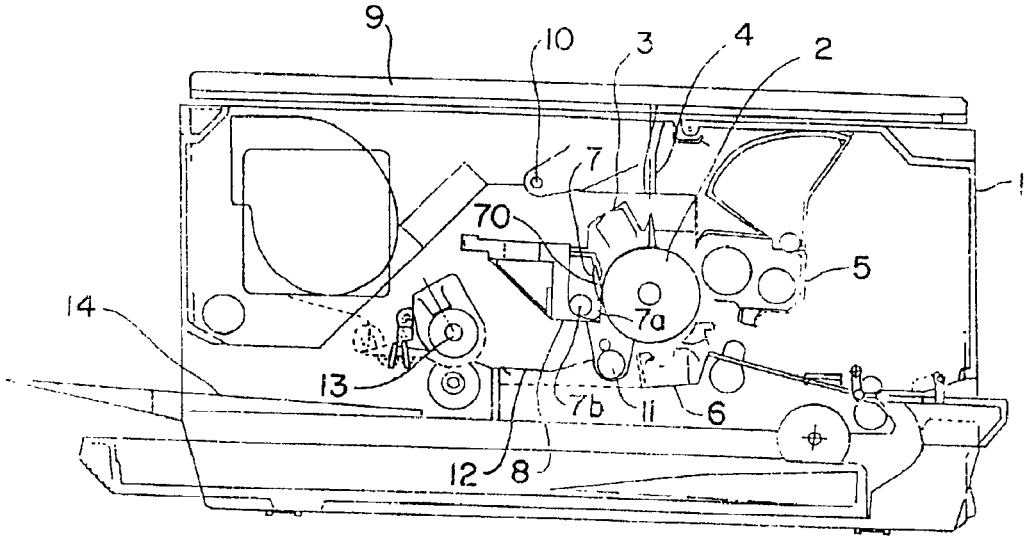
FIG. 1 is a schematic side sectional view of the electronic photocopying system according to this invention.

FIG. 1 is a schematic sectional view of an electronic photocopier according to this invention.

At the approximate center of the copying machine 1, a drum-shaped photosensitive device 2 formed to generate a copied image is provided. The photosensitive device 2 is held with a drive mechanism, not shown, for rotation.

Around the photosensitive device 2, a charger 3, light focuser/transmitter 4, developer 5, transferor 6, and cleaner 7 are arranged along the rotating direction to form the copying image. In this coping machine 1, at least the photosensitive device 2, charger 3 and cleaner 7 are held in one case to configure the first unit (module) 8. This first unit 8 is held with a guide supporter, not shown, on the equipment main body side and can be taken out or reinstalled by any one by using the mounting handle on the unit.

An original stand 9 which is used to set the original and expose it with the exposure light source 10 is movably positioned on the copying machine 1. This original stand 9 is scanned in the lateral direction with a drive unit, not shown. The optical image obtained by the irradiation with the exposure light source 10 is projected on the optical conductive layer on the surface of the photosensitive device by the light focuser/transmitter 4. By this, an electrostatic latent image is formed on the photosensitive device 2 according to the image of the original and this latent image is visualized by the developer 5, which is the second unit.

Figure 3:
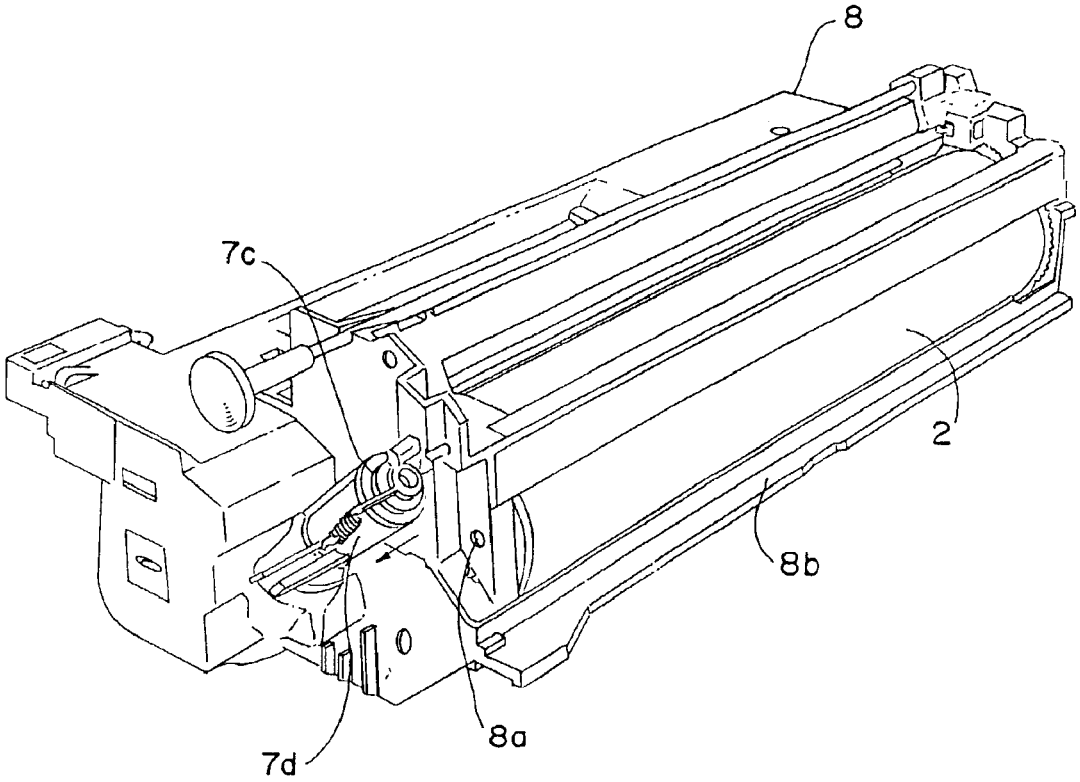
FIG. 3 is a general perspective view of the first unit.

Then, the image visualized by the said developer 5 (image of the toner) is transferred onto the transfer paper which is carried from the paper feeder at the proper time by the transferor 6. At this time, about 20% of the toner remains on the surface of the drum of the photosensitive device 2. In order to remove this toner and use the drum for the next image forming process, a cleaner 7 is provided. This cleaner 7 pushes an elastic cleaning blade 70 to the surface of the photoelectric device 2 to scrape off the remaining toner on the rotating photosensitive device 2. The toner scraped off with the cleaning blade 70 is received by the waste toner receiver 7*a* positioned under the cleaning blade. At the position of this waste toner receiver 7*a*, a waste toner feeder 7*b* is provided for rotation. The waste toner feeder 7*b* carries the toner dropped to the waste toner receiver 7*a* in the direction of the rotating axis of the photosensitive device to the one side of the first unit. On the one side, a toner carrier 7*c* to carry the toner whose carrying direction as shown in FIG. 3 makes a right angle to the previous carrying direction, is provided in connection with the above described waste toner feeder 7*b*. This toner carrier 7*c* faces the waste toner recovery container 56 which is provided in a single unit with the developer 5 described later.

Especially, the outlet port provided in the toner carrier 7*c* and the opening of the waste toner recovery container 56 are positioned to face each other. Structure for collecting the toner in the first unit comprises a toner collecting means.

On the other hand, the transfer paper which was sent to the transfer position is separated from the surface of the drum of the photosensitive device 2 with the separator 11 after the transfer of the image and sent to the overheat fixer 13 along the feeding guide 12. In the fixer 13, the image of the toner powder on the transfer paper is fixed by heat and pressure and the transfer paper after fixing is discharged to the paper discharger 14.

Figure 2:
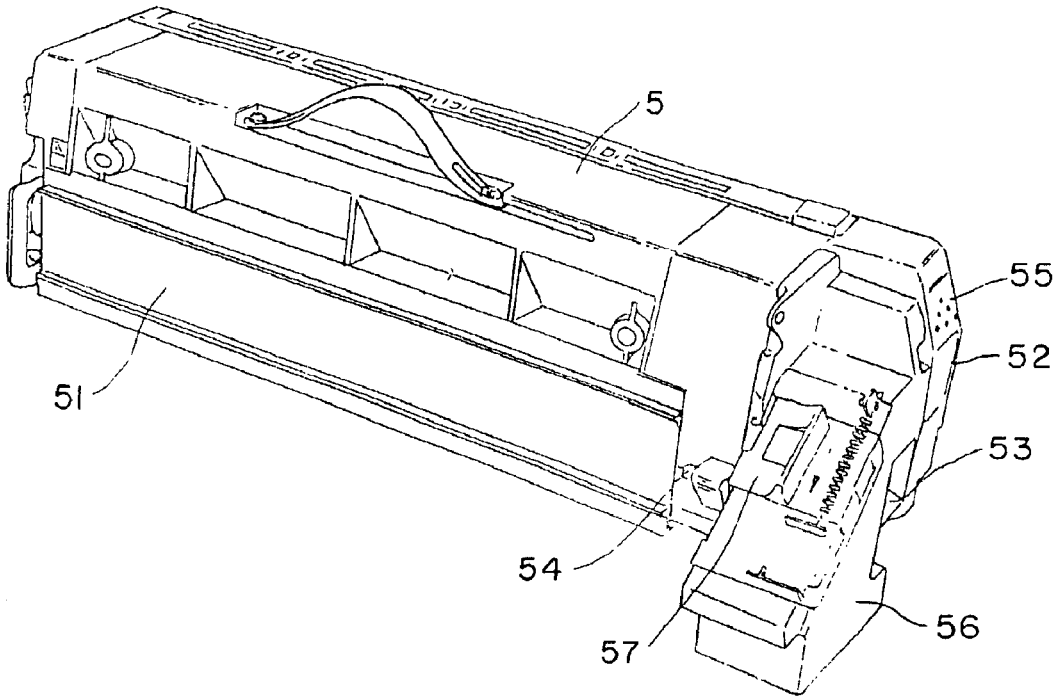
FIG. 2 is a general perspective view of the second unit.

FIG. 2 is a general perspective view of the second unit (module) consisting of the developer 5 and its waste toner recovery container 56. When the second unit is mounted to the main body of the coping machine, the cover 51 over the developing opening is separated to expose the magnetic brush of the toner generated on the developing sleeve and to mount it to the mounting position of the main body of the copying machine holding the second unit mounting handle 52. Number 54 indicates a positioning boss to be locked to the positioning hole 8*a* provided on the side of the first unit B and number 53 is a locking claw to hold the developer 5 when it is installed to the main body of the copying machine. Structure for delivering and receiving toner in a second unit comprises a toner handling means.

Number 55 indicates the color of the toner at the time of mono-color copying and can be seen from the indicating window 1*b* at the front cabinet 1*a*. Number 56 is a vessel for recovering waste toner which is carried from the first unit. Number 57 is the cover for the waste toner receiving port which is opened in the direction of the arrow when the second unit is mounted. It prevents the waste toner from overflowing when the unit is taken out. It is designed so that, when the above-described cover 57 is opened, this opening becomes coincident with the discharge port of the toner carrier 7*c* of the first unit.

The first and second units each have a first longitudinal side. The first sides are adjacent to each other when the units are mounted in the apparatus. Also, opposite the first longitudinal side, each unit has a second longitudinal side that contacts the apparatus when the units are mounted in the apparatus. Element 53 is an engaging portion of the second unit which is engaged to a body frame of the image forming apparatus. Element 53 is an engaging portion of the second unit which is engaged to a body frame of the image forming apparatus.

FIG. 3 is a general perspective view of the first unit 8 on the main body of the copying machine so as to be demounted from, or remounted to the;main body of the copying machine. The first unit 8, in at least one case as described above, has a drum of photosensitive agent and a cleaner 7 to remove toner remaining on the surface of the photosensitive device. The waste toner removed from the surface of the photosensitive device 2 by the cleaner 7 is carried to the one side of the first unit by the feeder 7*b*, and then discharged from the discharge port of the toner carrier 87*c*. This toner carrier 7*c* is provided with a cover 7*d* which moves in the direction of the arrow to open or close the discharge port. When the waste toner recovery container 56 provided in the second unit reaches a specified position, the cover 7*d* is opened opening the discharge port. The discharge port of the toner carrier 7*c* is provided so as to be coincident with the opening of the waste toner recovery container 56 of the second unit.

Figure 4:
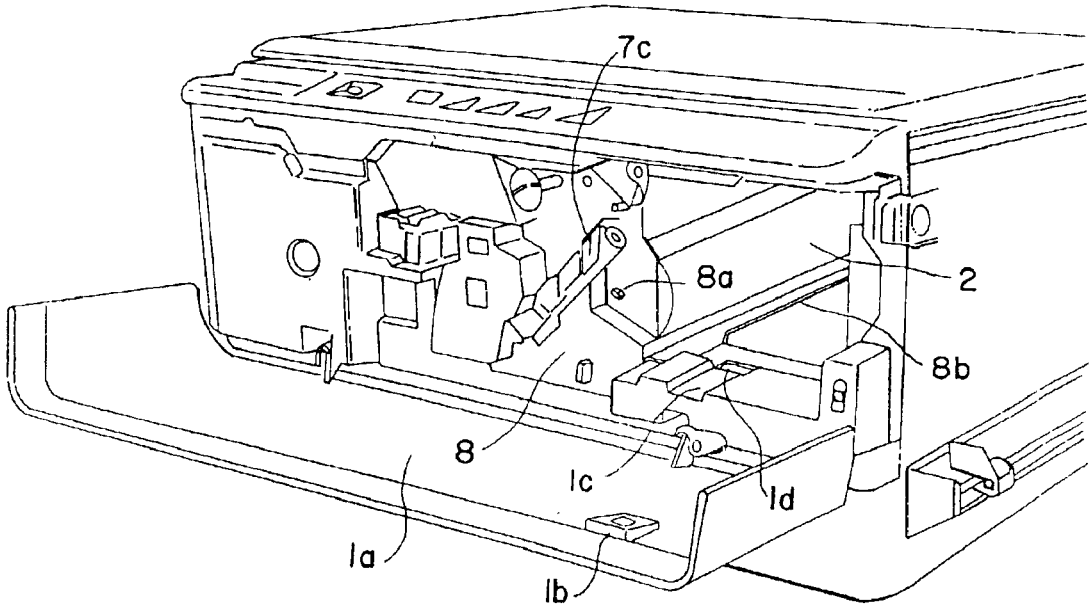
FIG. 4 is a perspective view of the copying machine with no second unit installed.

Here, the second unit cannot be installed unless the first unit 8 is installed to the main body of the copying machine. When the first unit 8 is installed to the main body of the equipment, a guide for the second unit is configured. For this purpose, the first unit 8 is provided with a guide 8*b* as shown in FIG. 3. This guide 8*b* provided on the first unit 8 not only guides the second unit, but also serves, together with the positioning 54 provided in the second unit, to position the developing magnetic brush precisely to the surface of the photoelectric drum. FIG. 4 shows the condition that the said first unit is mounted.

Figure 5:
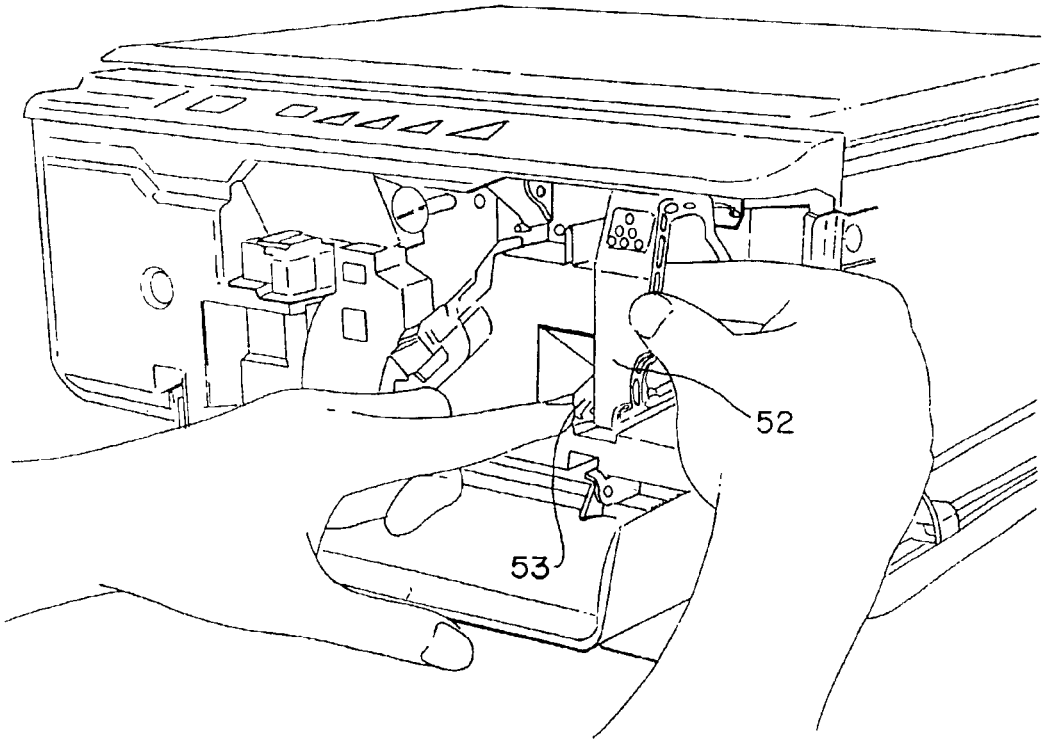
FIG. 5 is a perspective view of the copying machine with the second unit installed.

Mounting procedure for the second unit is described below with reference of FIGS. 4 and 5. The first unit 8 is mounted to the main body of the copying machine 1. The second unit is inserted to the main body of the copying machine with its bottom part advancing along the guide 1*c* formed by a part of the frame of the main body of the copying machine. Thus the second unit is led to the inner part by the guide 8*b* provided in the first unit 8 and connected to the image unit driver, not shown, in the inner part of the main body of the copying machine. At the same time, the positioning boss 54 of the second unit is fitted to the positioning hole 8*a* of the first unit 8 and locked. Since it is not restrained and may jump out, it is hitched to the catch 1*d* of the guide 1*c* of the frame of the main body of the copying machine with the locking claw 53 provided on the unit.

Upon the completion of the insertion of the second unit, the covers 7*d* and 57 provided, respectively, at the discharge port of the toner carrier 7*c* to carry the waste toner on the first unit 8 and the opening of the waste toner recovery container 56, are opened so that the discharge port and receiving port align with each other and the recovery of waste toner to recovery container 56 becomes possible. FIG. 5 shows the condition where the second unit is installed.

By the above configuration, the second unit is positioned to the first unit 8, and, while the main body of the copying machine is working, the toner remaining on the photosensitive device 2 is carried through each feeder and carrier and delivered to the recovery container 56 held in the second unit. When the life of the second unit including the developer 5 has expired, for instance, when the toner of the developer 5 has been exhausted, only the second unit needs to be replaced. Therefore it is not necessary to increase the volume of the second unit including the developer 5 as a consequence of the life of the photosensitive device 2 in the first unit 8. Therefore, the life of the second unit needs not correspond to the first unit and can be smaller as a result.

The size of the toner recovery container 56 has no correlation with the life of the first unit 8 and therefore, its size can be freely determined. It is advisable to determine the size of the waste toner recovery container 56 based on the capacity of the developer 5 to contain the toner. For instance, the capacity may be determined so that the toner of the developer 5 of the second unit is exhausted before the life of the photosensitive device 2 has expired and the waste recovery container becomes almost filled with waste toner when the second unit is replaced. In other words, the size of the recovery container 56 may be determined so that the recovery container 56 is almost filled with waste toner when the second unit is replaced. As indicated the residue toner enters the recovery container only. As such the waste does not mix with the toner of the toner developer unit as the residue toner container is self-contained and separate from the developing unit.

As described above, in the system according to this invention, when the toner has been exhausted and the unit with a developer is replaced, the vessel to recover the waste toner which was recovered while the said unit was working is also replaced and therefore replacement is made in a short time and done easily. The image former is divided into two units which have extremely different lives and as a result, each unit can be used effectively until its life has expired and can be made smaller.

Accordingly, each of the two units has a life of interchange different from the other. The "life of interchange" is the length of time that a unit can remain in the machine without being removed. Since the second unit contains a depletable supply of toner, as described above, its life of interchange in the machine is determined by the consumption of that supply in the machine. On the other hand, the first unit has a life of interchange in the machine determined by the useful life of the photosensitive image carrier mechanism, which is substantially greater than the life of interchange of the second unit (toner supply). As described above, the second unit is removed and replaced with the first unit remaining in the machine.

While only certain embodiments of the present invention have been described, it will be apparent to those skilled in the art that various changes and modifications may be made therein without departing from the spirit and scope of the present invention as claimed.

What is claimed is:

1. An image forming apparatus comprising:

a first unit which includes a photosensitive body and a cleaning means, the first unit having a first life of interchange;

a second unit which includes a developing unit and a self contained residue toner container separated from the developing unit, so that residue toner does not mix with developer toner in the developing unit, the second unit having a second life of interchange shorter than the first life of interchange and being removable from and replaceable in said apparatus independently of said first unit;

means for communicating said cleaning means with said residue toner container when said second unit is mounted;

means in said apparatus for removably receiving and mounting each of said units adjacent to each other; and said second unit provided with an engaging portion, said engaging portion being engaged to a body frame of the image forming apparatus.

2. The image formation apparatus of claim 1, wherein said second unit further includes externally disposed visual identification means identifying a characteristic of the toner therein.

3. The image forming apparatus of claim 1, wherein said photosensitive body is a drum.

4. The image forming apparatus of claim 1, wherein the insertion therein of said first unit enables the subsequent insertion therein of said second unit.

5. The image forming apparatus according to claim 1, wherein the developer toner in the developing unit is solely fresh developing toner.

6. The image forming apparatus according to claim 1, wherein each of the first and second units has a first longitudinal side adjacent to each other and a second longitudinal side in direct physical contact with a main body of the image forming apparatus.

7. The image forming apparatus according to claim 1, wherein the lives of interchange are those lives spent within the image forming apparatus.

8. An image apparatus comprising:

a first unit which includes a photosensitive body and a cleaning means the first unit having a first life of interchange;

a second unit which includes a developing unit and a self contained residue toner container separated from the developing unit, so that residue toner does not mix with the developer toner in the developing unit and having a second life of interchange which is shorter than said first life of interchange and being removable from and replaceable in said apparatus independently of said first unit;

means for positioning said photosensitive body and said developing unit in the image apparatus, respectively, means for communicating said cleaning means with said residue toner container, and said second unit provided with an engaging portion, said engaging portion being engaged to a body frame of the image forming apparatus.

9. The image forming apparatus as claimed in claim 1, wherein said second unit can be inserted adjacent said first unit only when said first unit is located in said apparatus.

10. The image formation apparatus as claimed in claim 8, wherein upon interchange of said second unit, said residue toner container is interchanged at the same time.

11. The image forming apparatus according to claim 8, wherein the developer toner in the developing unit is solely fresh developing toner.

* * * * *